US006375509B2

(12) United States Patent
Mountford

(10) Patent No.: US 6,375,509 B2
(45) Date of Patent: Apr. 23, 2002

(54) ELECTRICAL COUPLINGS, CONNECTORS AND COMPONENTS

(75) Inventor: Lorna Catherine Mountford, Feltham (GB)

(73) Assignee: Smiths Group plc, London (GB)

( * ) Notice: Subject to any disclaimer, the term of this patent is extended or adjusted under 35 U.S.C. 154(b) by 0 days.

(21) Appl. No.: 09/725,715

(22) Filed: Nov. 30, 2000

(30) Foreign Application Priority Data

Nov. 30, 1999 (GB) ..... 9928256

(51) Int. Cl.[7] ..... H01R 9/03
(52) U.S. Cl. ..... 439/610; 439/321
(58) Field of Search ..... 439/610, 312, 439/321

(56) References Cited

U.S. PATENT DOCUMENTS 6,123,563 A * 9/2000 Johnson et al. ..... 439/321
6,162,095 A * 12/2000 Holman ..... 439/610
6,276,967 B1 * 8/2001 Hall ..... 439/610

FOREIGN PATENT DOCUMENTS

GB 2344703 A 6/2000

* cited by examiner

*Primary Examiner*—Tho D. Ta
(74) *Attorney, Agent, or Firm*—Connolly Bove Lodge & Hutz

(57) ABSTRACT

A backshell 2 of an electrical connector has an outer nut 20 screwed onto the rear of the connector front assembly 1, which is formed with triangular locking teeth 13. An internal assembly 50 within the nut 20 prevents rotation of the backshell 2 on the connector when locked in position. The internal assembly 50 includes a rear cylinder 70 and a forward annular member 80 located between the cylinder and the front assembly 1. The cylinder 70 is of metal-plated plastics, which makes electrical connection at its rear end with screens 5 of cables 3 within the connector. The annular member 80 is of a metal and at its forward end has triangular teeth 85 that engage the teeth 13 at the rear of the front assembly 1. The rear of the annular member 80 and the forward end of the cylinder 70 both have rounded teeth 82 and 74 that engage with one another so as to avoid sharp edges on the cylinder that could lead to damage to its plating 170 caused by electrical transients.

12 Claims, 3 Drawing Sheets

ELECTRICAL COUPLINGS, CONNECTORS AND COMPONENTS

BACKGROUND OF THE INVENTION

This invention relates to electrical couplings, connectors and components for such couplings or connectors.

Electrical connectors and couplings are usually made of metal, or include metal components, in order to provide strength and electrical conduction properties, such as for screening or grounding purposes. These metal components contribute a significant part of the overall mass of the connector. This can create problems in applications where it is important for weight to be kept to a minimum, such as in aircraft, and can increase the risk of vibration damage. It has previously been proposed that various metal components be replaced by components made of plastics materials, which may be electrically conductive where this is necessary. An effective way of making a plastics component electrically conductive is to plate it with a metal, such as described in GB 2344703. There is, however, a problem with plated plastics components that connect with another component in a toothed or similarly sharply pointed region, if the component is exposed to lightning strike. The high current flow produced by the lightning generates an electric field that is more intense at the pointed region and may cause delamination of the plating from the plastics substrate.

BRIEF SUMMARY OF THE INVENTION

It is an object of the present invention to provide an alternative connector, coupling and component for such a connector or coupling.

According to one aspect of the present invention there is provided a coupling including a first cylindrical member of an electrically-insulative material plated with an electrically-conductive material and arranged to lock against rotational movement relative to a second member, the second member having a ring of sharp-edged locking teeth at its rear end, the coupling including an annular member of an electrically-conductive material disposed axially between the first and second members, the annular member having a ring of sharp-edged locking teeth at its forward end arranged to engage the teeth at the rear end of the second member, and the forward end of the first member and the rear end of the annular member each having a ring of smoothly rounded teeth that engage one another to prevent relative rotation between the first and annular members.

The first member is preferably of a plastics material and the sharp-edged teeth are preferably substantially triangular. The annular member may be of a metal, such as aluminium and may be plated with a metal. Preferably, the annular member and the first member are both plated with the same metal.

According to another aspect of the present invention there is provided an electrical connector backshell assembly including an outer metal nut threaded internally towards its forward end such that it can engage a screw thread on the outside of a connector front end assembly, an internal assembly within the nut for restraining rotation of the backshell assembly when fitted on the front end assembly, the internal assembly including a cylinder towards the rear of the assembly and a shorter annular member towards the forward end of the assembly, the cylinder being of a plastics material plated with a metal and having a series of smoothly rounded teeth at its forward end, and the annular member being of a metal and having at its rear end a series of smoothly rounded teeth shaped to engage with the teeth on the cylinder and having at its forward end a series of triangular teeth shaped to engage triangular teeth around the rear end of the front end assembly.

According to a further aspect of the present invention there is provided an electrical connector including a backshell assembly according to the above other aspect of the invention.

According to a fourth aspect of the present invention there is provided an internal assembly for use in an electrical coupling for restraining rotation of components of the coupling, the internal assembly including a cylinder and a shorter annular member located at the forward end of the cylinder, the cylinder being of a plastics material plated with a metal and having a series of smoothly rounded teeth at its forward end, and the annular member being of a metal and having at its rear end a series of smoothly rounded teeth shaped to engage the teeth on the cylinder and having at its forward end a series of triangular teeth shaped to engage triangular teeth around an engaging component of the coupling.

According to a fifth aspect of the present invention there is provided a coupling including an internal assembly according to the above fourth aspect of the invention.

An electrical connector according to the present invention, will now be described, by way of example, with reference to the accompanying drawings.

BRIEF DESCRIPTION OF THE PREFERRED DRAWINGS

DETAILED DESCRIPTION OF THE PREFERRED EMBODIMENT

Figure 1:
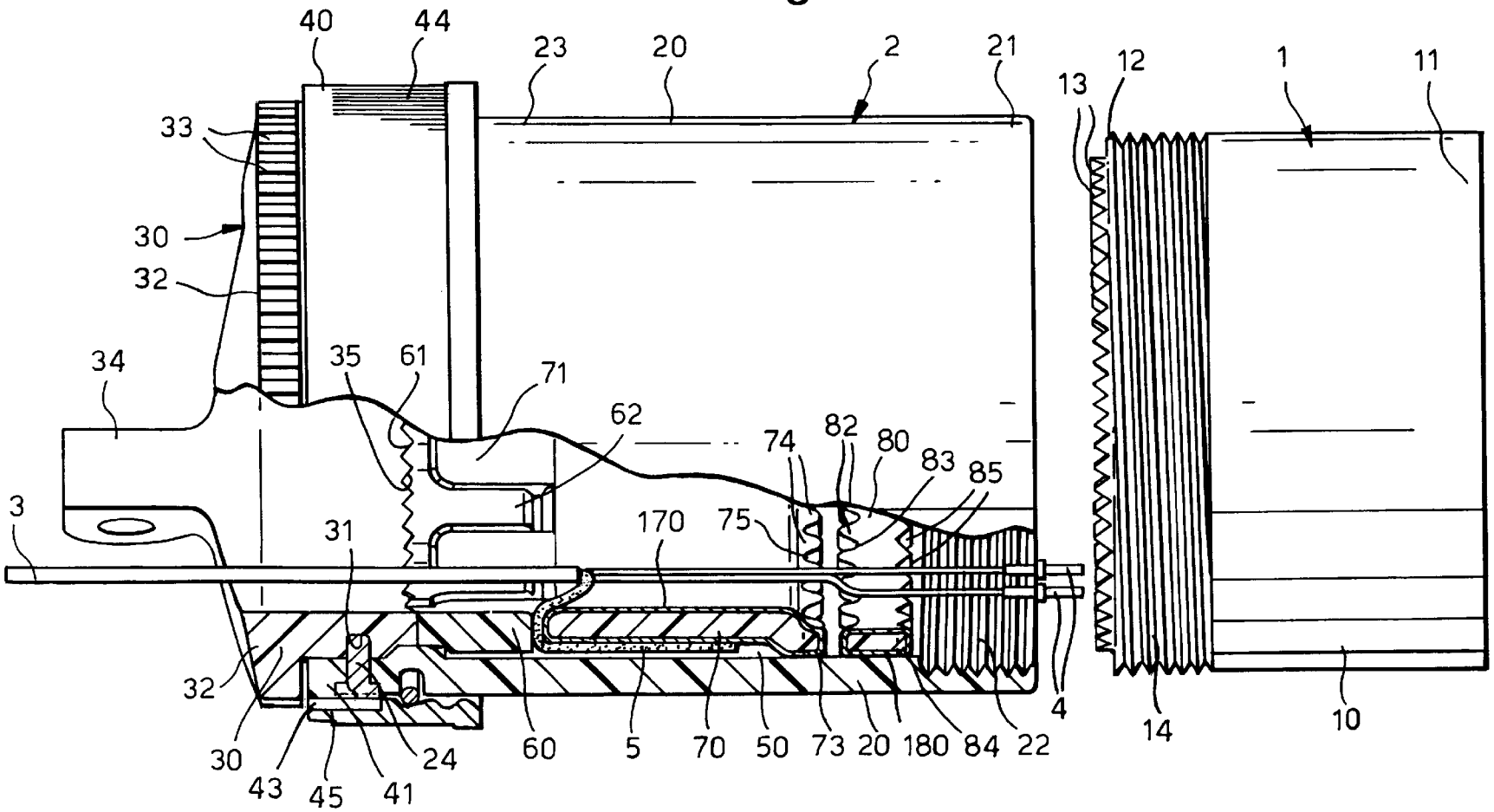
FIG. 1 is a partly sectional side elevation view of the connector.
Figure 2:
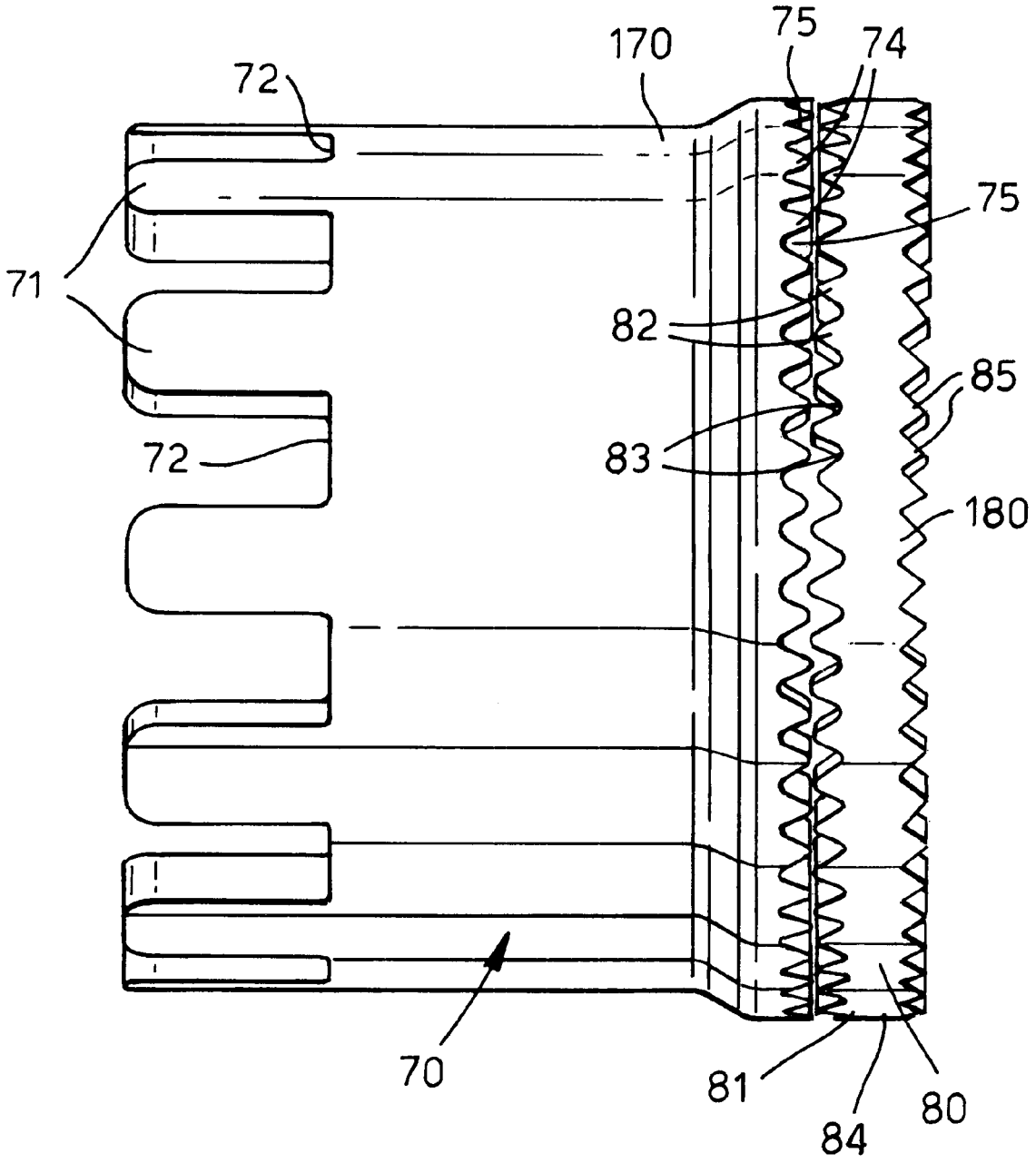
FIG. 2 is a side elevation of components of the connector.
Figure 3:
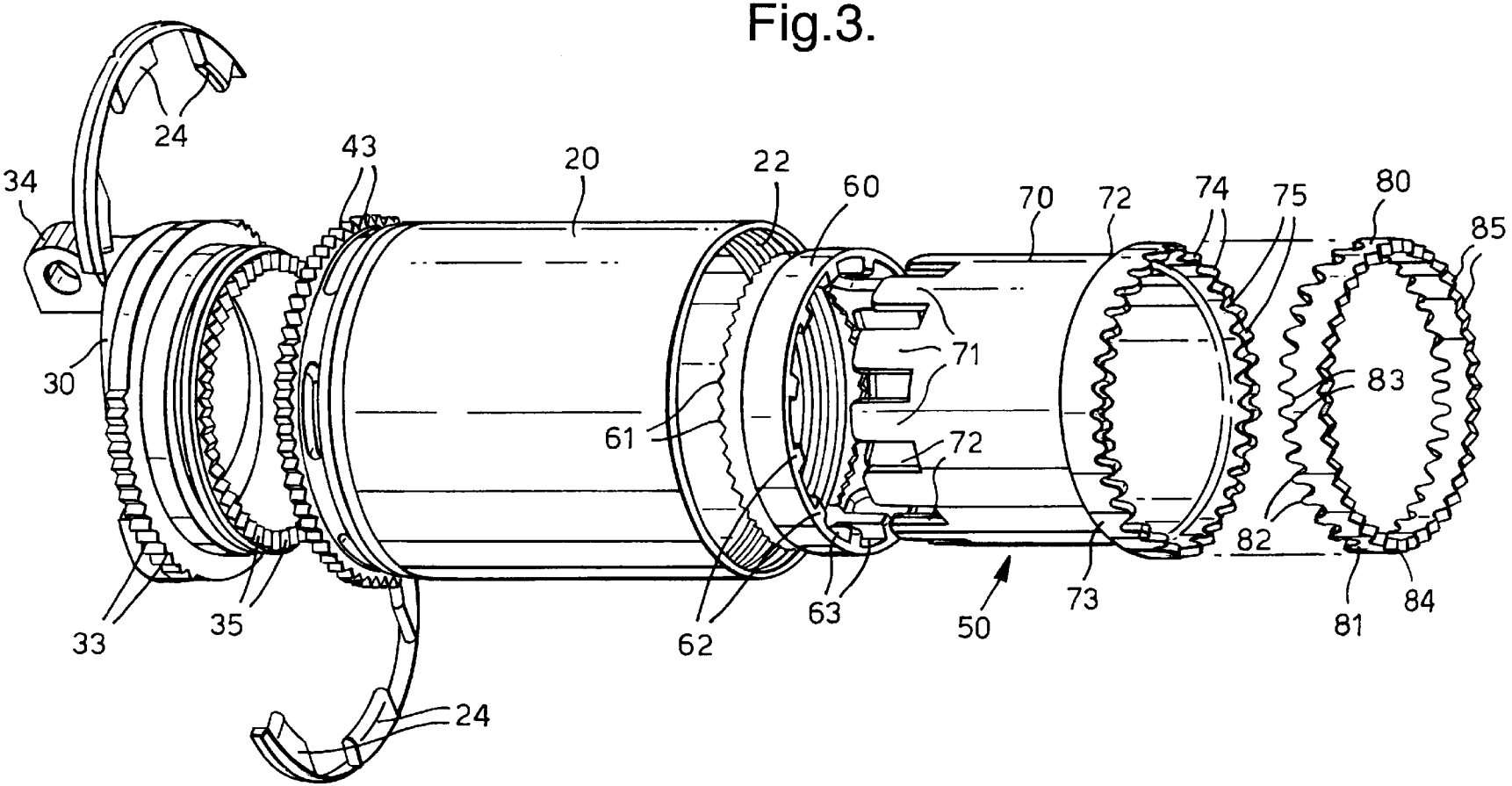
FIG. 3 is a perspective view of a part of the connector.

The connector comprises a front end assembly 1 of conventional form and a backshell assembly or accessory 2 mounted on the rear end of the front end assembly. A bundle of cables, only one of which 3 is shown, extends through the backshell assembly 2, the cables making connection with contacts 4 mounted in the front end assembly 1.

The front end assembly 1 has an outer cylindrical metal shell 10 containing an insulative insert (not shown) supporting the contacts 4. The forward end 11 of the shell 10 is open to allow access to the contacts by a mating connector (not shown). The rear end 12 of the shell 10 is formed with a ring of triangular locking teeth 13, of conventional form, which may be slightly radiused at their points. The outer surface of the shell 10 is cut with a screw thread 14 towards its rear end 12.

The backshell assembly 2 has an outer coupling nut 20 moulded from a rigid plastics material. The forward end 21 of the nut 20 is formed on its inner surface with a screw thread 22 that can engage the thread 14 on the front end assembly 1. The rear end 23 of the nut 20 is mounted for free rotation on a rear end body 30 by means of keys 24 that project inwardly from the nut into a groove 31 around the outside of the body. The rear end body 30 has an outwardly-projecting flange 32 formed with longitudinally-extending splines 33 around its edge. The rear end body 30 is open and has fastening members 34 at its rear end. At its forward end, the body 30 is formed with a ring of triangular locking teeth 35 of the same form as the teeth 13 on the front end assembly 1.

The coupling nut 20 carries a locking mechanism 40 of the kind described in GB 2270805, which serves to lock the nut against rotation on the body 30 at any desired angular position. The locking mechanism 40 includes an outwardly-projecting flange 41 at the rear end of the nut 20 having splines 43 corresponding to the splines 33 on the body 30. A locking ring 44 is mounted on the rear end of the nut 20, the ring having splines 45 formed around its inner surface at its rear end, which engage the splines 33 on the nut. The locking ring 44 is slidable on the nut 20 from a first, forward, unlocked position, as shown in FIG. 1, to a second, rear position where the ring projects over the flange 32 on the rear end body 30 and where the splines 45 on the ring engage the splines 33 on the body.

The backshell assembly 2 also includes an internal assembly 50 that serves both to lock the front end assembly 1 from rotation relative to the rear end body 30 and to make electrical screening connection to braided screening sleeves 5 on the cables 3. In the present invention, this internal assembly 50 comprises three separate components that engage one another axially. The rearmost component is an annular cap 60 moulded of a plastics material. The cap 60 has a ring of triangular teeth 61 around its rear end, which engage the teeth 35 on the forward end of the rear end body 30, so as to prevent relative rotation between these components. At its forward end, the cap 60 has a series of shallow, inwardly-extending projections 62 defining between them a series of axially-extending recesses 63.

The next component of the internal assembly 50 is a cylinder 70 moulded of a rigid, electrically-insulative plastics material, such as PEEK, and plated with a layer 170 of a metal such as copper to make it electrically conductive. The copper is covered with an outer layer of nickel to protect it from corrosion. The external diameter of the cylinder 70 at its rear end is equal to the internal diameter of the cap 60 in the recesses 63. The cylinder 70 is moulded at its rear end with twelve castellations 71 forming an equal number of recesses 72. The castellations 71 extend longitudinally in a rearwards direction, each engaging in a respective one of the recesses 63 at the forward end of the cap 60. The engagement of the castellations 71 in the cap 60 serves both to prevent relative rotation between these two components and to trap the braided screens 5 between them so that these are electrically connected with the cylinder 70. The forward end 72 of the cylinder 70 is increased slightly in diameter to form a short lip 73. The forward end of the lip 73 is moulded with a series of forwardly-projecting teeth 74. The teeth 74 are smoothly rounded and the floor 75 between the teeth is also smoothly rounded so that there are no sharp edges to the end profile of the cylinder 70. The number of teeth 74 can vary from connector to connector but typically there are at least as many teeth as castellations 71.

The third component of the internal assembly 50 is an annular member 80 machined from aluminium and plated with an outer layer 180 of nickel to protect it from corrosion. The annular member 80 could be of other electrically-conductive materials but the outer, contacting surfaces of the cylinder 70 and the annular member 80 should be of the same material, or of compatible materials, so as to avoid galvanic corrosion. The rear end 81 of the annular member 80 is machined, or otherwise formed with a ring of rounded teeth 82 separated by rounded floors 83. The teeth 82 and floors 83 on the annular member 80 have the same profile as the teeth 74 and floors 75 on the cylinder 70 so that the two sets of teeth engage one another closely and prevent relative rotation between the two components. At its forward end 84, the annular member 80 is formed with a second ring of teeth 85; these are of triangular shape and match the teeth 13 on the front end assembly 1 so that, when engaged, they prevent relative rotation between the annular member and the front end assembly.

When the connector assembly is assembled, the nut 20 is screwed onto the front end assembly 1. Rotation of the front end assembly 1 relative to the rear end body 30 is prevented by the interengagement of the components of the internal assembly 50 with the teeth 35 and 13 on the rear end body 30 and the front end assembly 1. When fully tightened, these components are clamped securely with one another end to end. Electrical connection of the screening braids 5 of the cables 3 is established to the shell 10 of the front end assembly 1 and the nut 20 via the cylinder 70 and annular member 80. If the cable braids 5 or connector assembly should be subject to a high energy electrical transient, such as caused by a lightning strike, this could cause high electrical energy to pass through the conductive components of the internal assembly 50. The cylinder 20 would be susceptible to damage to its plating if this electrical energy should become localized. However, because it connects with the adjacent conductive component 80 via a smoothly rounded surface, there is a considerably reduced risk of localization of energy compared with what would be the case if the teeth were triangular or of other sharp shape. The electrical connection between the annular member 80 and the front end assembly 1 is via triangular teeth 85 and 13, which may cause very high localized electrical fields. However, there is little risk of this causing damage to the plating on the annular member 80 because the plating is on a metal substrate to which there is better adherence than non-metallic substrates.

The present invention enables non-metallic components to be used in connectors and couplings with a reduced risk of damage.

What I claim is:

1. A coupling comprising: a first cylindrical member of an electrically-insulative material, said first member being plated with an electrically-conductive material; a second member having a ring of sharp-edged locking teeth at its rear end; and an annular member of an electrically-conductive material, said annular member being disposed axially between said first and second members, wherein said annular member has a ring of sharp-edged locking teeth at its forward end arranged to engage the said teeth at the rear end of said second member, and wherein the forward end of said first member and the rear end of said annular member each have a ring of smoothly rounded teeth that engage one another to prevent relative rotation between the first and annular members.

2. A coupling according to claim 1, wherein said annular member is of a metal.

3. A coupling according to claim 2, wherein the said metal is aluminum.

4. A coupling according to claim 2, wherein said annular member is plated with a metal.

5. A coupling according to claim 4, wherein said annular member and said first member are both plated with the same metal.

6. A coupling according to claim 1, wherein said first member is of a plastics material.

7. A coupling according to claim 6, wherein said annular member is of a metal.

8. A coupling according to claim 1, wherein the sharp-edged teeth are substantially triangular.

9. A coupling according to claim 8, wherein said annular member is of a metal.

10. An electrical connector backshell assembly for fitting to a connector front end assembly that has a series of triangular teeth around its rear end, said backshell assembly comprising: an outer metal nut, said nut being threaded internally towards its forward end such that it can engage a screw thread on the outside of said front end assembly; and an internal assembly within said nut for restraining rotation of said backshell assembly when fitted on said front end assembly, wherein said internal assembly includes a cylinder towards the rear of said assembly and a shorter annular member towards the forward end of said assembly, wherein said cylinder is of a plastics material plated with a metal and has a series of smoothly rounded teeth at its forward end, and wherein said annular member is of a metal and has at its rear end a series of smoothly rounded teeth shaped to engage the said teeth on said cylinder and has at its forward end a series of triangular teeth shaped to engage the said triangular teeth around the rear end of said front end assembly.

11. An electrical connector comprising: a connector front end assembly having a series of triangular teeth around its rear end and having a screw thread on its outside; a backshell assembly fitted on the rear end of said front end assembly, said backshell assembly including an outer metal nut, said nut being threaded internally towards its forward end such that it engages the said screw thread on said front end assembly, an internal assembly within said nut for restraining rotation of said backshell assembly, wherein said internal assembly includes a cylinder towards the rear of said assembly and a shorter annular member towards the forward end of said assembly, wherein said cylinder is of a plastics material plated with a metal and has a series of smoothly rounded teeth at its forward end, and wherein said annular member is of a metal and has at its rear end a series of smoothly rounded teeth shaped to engage the said teeth on said cylinder and has at its forward end a series of triangular teeth engaged with said triangular teeth on said front end assembly.

12. An internal assembly for use in an electrical coupling for restraining rotation of components of said coupling, wherein said internal assembly comprises: a cylinder and a shorter annular member located at a forward end of said cylinder, wherein said cylinder is of a plastics material plated with a metal and has a series of smoothly rounded teeth at said forward end, and wherein said annular member is of a metal and has at its rear end a series of smoothly rounded teeth shaped to engage the said teeth on said cylinder and has at its forward end a series of triangular teeth shaped to engage triangular teeth around an engaging component of said coupling.

* * * * *